US009562733B2

(12) United States Patent
Huther

(10) Patent No.: US 9,562,733 B2
(45) **Date of Patent: *Feb. 7, 2017**

(54) FIREARM FIRE CONTROL SELECTOR

(71) Applicant: COLT'S MANUFACTURING IP HOLDING COMPANY LLC, West Hartford, CT (US)

(72) Inventor: John Huther, Rochester, NY (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/312,684

(22) Filed: Jun. 23, 2014

(65) Prior Publication Data

US 2015/0300763 A1 Oct. 22, 2015

Related U.S. Application Data

(63) Continuation of application No. 11/351,631, filed on Feb. 9, 2006, now Pat. No. 8,756,847.

(51) Int. Cl.
*F41A 17/74* (2006.01)
*F41A 35/06* (2006.01)
(Continued)

(52) U.S. Cl.
CPC ..... *F41A 19/46* (2013.01); *F41A 17/74* (2013.01); *F41A 19/02* (2013.01); *F41A 35/06* (2013.01)

(58) Field of Classification Search
CPC ..... F41A 17/00; F41A 17/46; F41A 17/56; F41A 17/74; F41A 35/06; F41A 19/46
(Continued)

(56) References Cited

U.S. PATENT DOCUMENTS 3,045,555 A 7/1962 Stoner
3,292,492 A 12/1966 Sturtevant
(Continued)

OTHER PUBLICATIONS

Remington Defense, Remington RGP Brochure.
Bushmaster Firearms, Intl., ACR Rifle Manual.

*Primary Examiner* — Jonathan C Weber
(74) *Attorney, Agent, or Firm* — Cantor Colburn LLP

(57) ABSTRACT

A method of providing a semi-automatic rifle with a reversible safety selector is provided. The method including the steps of: removably and rotatably locating a reversible safety selector in a receiver having a first side and an opposite second side, the reversible safety selector having a selector member and a shaft extending therefrom, the shaft being rotationally received within the receiver and the shaft further comprising a first position selection feature proximate to the selector member and a second position selection feature distal to the selector member, wherein a camming surface is located between the first position selection feature and the second position selection feature, wherein the first position selection feature is configured to only engage a spring biased detent of the receiver when the reversible safety selector is rotated between a first position and a second position with respect to the receiver when the selector member is located on the first side of the receiver, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver.

24 Claims, 8 Drawing Sheets

(51) Int. Cl.
*F41A 19/46* (2006.01)
*F41A 19/02* (2006.01)

(58) Field of Classification Search
USPC ..... 89/132, 142, 144, 148; 42/70.01, 70.04, 42/70.05
See application file for complete search history.

(56) References Cited

U.S. PATENT DOCUMENTS

| | | | | |
|---|---|---|---|---|
| 3,492,748 | A | 2/1970 | Swenson | |
| 4,282,795 | A | 8/1981 | Beretta | |
| 4,414,769 | A | 11/1983 | Mueschke | |
| 4,433,610 | A | 2/1984 | Tatro | |
| 4,463,654 | A | 8/1984 | Barnes et al. | |
| 4,512,100 | A | 4/1985 | Dheur | |
| 4,589,327 | A | 5/1986 | Smith | |
| 4,590,697 | A | 5/1986 | Ruger et al. | |
| 4,681,020 | A | 7/1987 | Polanecky | |
| 4,726,136 | A | 2/1988 | Dornaus et al. | |
| 5,157,209 | A | 10/1992 | Dunn | |
| 5,212,327 | A | 5/1993 | Schuemann | |
| 5,245,776 | A | 9/1993 | Dornaus | |
| 5,293,708 | A | 3/1994 | Strayer et al. | |
| 5,519,954 | A | 5/1996 | Garnett | |
| 5,736,667 | A | 4/1998 | Munostes et al. | |
| 5,870,846 | A | 2/1999 | Ledford | |
| 5,903,994 | A | 5/1999 | Tange | |
| 6,257,116 | B1 | 7/2001 | Moczijdlower et al. | |
| 6,389,728 | B1 | 5/2002 | Lundy | |
| 6,557,289 | B2 | 5/2003 | Stall et al. | |
| 6,588,136 | B2 | 7/2003 | Baker et al. | |
| 6,711,819 | B2 | 3/2004 | Stall et al. | |
| 6,907,814 | B2 | 6/2005 | Spinner et al. | |
| 7,219,462 | B2 | 5/2007 | Finn | |
| 7,240,600 | B1 | 7/2007 | Bordson | |
| 7,421,937 | B1 | 9/2008 | Gangl | |
| 7,596,900 | B2 | 10/2009 | Robinson et al. | |
| 7,661,219 | B1 | 2/2010 | Knight et al. | |
| 7,707,921 | B1 | 5/2010 | Hoel | |
| 7,798,045 | B1 | 9/2010 | Fitzpatrick et al. | |
| 8,756,847 | B2 * | 6/2014 | Huther ..... | F41A 17/74 42/70.01 |
| 2001/0022131 | A1 | 9/2001 | Moczijdlower et al. | |
| 2004/0010917 | A1 | 1/2004 | Stall et al. | |
| 2005/0262752 | A1 | 12/2005 | Robinson et al. | |
| 2006/0123683 | A1 | 6/2006 | Garrett et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2010/0281736 | A1 | 11/2010 | Mayberry et al. | |

* cited by examiner

FIREARM FIRE CONTROL SELECTOR

CROSS REFERENCE TO RELATED APPLICATIONS

This application is a continuation of U.S. patent application Ser. No. 11/351,631 filed Feb. 9, 2006, the contents of which are incorporated herein by reference thereto.

BACKGROUND

1. Field

The disclosed embodiments relate to a firearm and, more particularly, to a firearm having an ambidextrous fire control selector.

2. Description of Earlier Related Developments

Automatic and semi-automatic firearms may be provided with a fire control selector enabling the user to switch between modes of fire, such as for example, "SAFE", semi-automatic, burst and/or automatic. For example, U.S. Pat. Nos. 5,760,328 and 4,433,610, which are incorporated herein by reference in their entirety; disclose M-4 type firearms, each having a fire control selector protruding from the receiver of the firearm. Here, the user rotates the fire control selector with a thumb or other finger(s) to switch between firearm modes of operation. A problem arises when a user would like to switch hands of operation of the firearm. A further problem arises when a user would like to switch from a right hand selector operation to a left hand selector operation without additional parts. Accordingly, there is a desire to provide a firearm control selector that enables ambidextrous operation where the firearm selector is configurable from right hand to left hand operation.

SUMMARY OF THE EMBODIMENTS

In accordance with the first exemplary embodiment a semi-automatic M-4 type firearm is provided. The firearm comprises a receiver and a reversible safety selector. The receiver has a right side and a left side. The reversible safety selector is rotatably coupled to the receiver and comprises a shaft with a user selector member at one end. The user selector member is adapted to allow a user to move the reversible safety selector relative to the receiver. The reversible safety selector is adapted to be mounted to the receiver in a first position with the user selector member located on the right side of the receiver. The reversible safety selector may be mounted to the receiver in a second position different from the first position with the user selector member located on the left side of the receiver.

In accordance with another exemplary embodiment, a firearm capable of semi-automatic fire is provided. The firearm comprises a receiver, a selector and a trigger. The receiver has a movable hammer located therein and has a bore formed therethrough. The selector is rotatably mounted in the bore through the receiver. The selector has a selector member and a camming surface. The trigger is movably mounted in the receiver and has a sear thereon to engage the hammer. The camming surface of the selector is adapted to engage the trigger when rotated relative to the receiver. The selector has a number of selectable positions disposed for selection by rotation of the selector. The selector is capable of being removably mounted to the receiver by insertion into the bore from both a right side of the receiver and a left side of the receiver.

In accordance with yet another exemplary embodiment, a safety selector for a semi-automatic firearm is provided. The safety selector comprises a selector lever, a first supporting surface, a trigger camming surface and a second supporting surface. The first supporting surface is connected to the selector lever. The first supporting surface is adapted to movingly support the safety selector in a firearm receiver and has first detent features. The trigger camming surface is connected to the first supporting surface. The second supporting surface is connected to the trigger camming surface. The second supporting surface is adapted to movingly support the safety selector in the firearm receiver and has second detent features. The first detent features and the second detent features each define two index positions of the safety selector. The second detent features are substantially inverted from the first detent features.

In yet another embodiment, a method of providing a semi-automatic rifle with a reversible safety selector is provided. The method including the steps of: removably and rotatably locating a reversible safety selector in a receiver having a first side and an opposite second side, the reversible safety selector having a selector member and a shaft extending therefrom, the shaft being rotationally received within the receiver and the shaft further comprising a first position selection feature proximate to the selector member and a second position selection feature distal to the selector member, wherein a camming surface is located between the first position selection feature and the second position selection feature, wherein the first position selection feature is configured to only engage a spring biased detent of the receiver when the reversible safety selector is rotated between a first position and a second position with respect to the receiver when the selector member is located on the first side of the receiver, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver.

In yet another embodiment, a method of providing a firearm capable of semi-automatic fire is provided. The method including the steps of: removably and rotatably locating a selector in a bore extending through a receiver having a moveable hammer, the selector having a selector member, a pair of first detent engagement features, a pair of second detent engagement features and a camming surface positioned between the pair of first detent engagement features and the pair of second detent engagement features; and a trigger movably mounted to the receiver and having an integral sear configured to engage the hammer, wherein the camming surface of the selector is configured to engage the trigger when the selector is rotated relative to the receiver; and wherein the selector is capable of being removably inserted into the bore from both a right side of the receiver and a left side of the receiver and wherein, the receiver further comprises a spring biased detent, and wherein, the pair of first detent engagement features only engage the detent when the selector member is located on the right side of the receiver and the pair of second detent engagement features only engage the detent when the selector member is located on the left side of the receiver.

In yet another embodiment, a method of providing a safety selector in a semi-automatic firearm is provided. The method including the steps of: movingly supporting a safety selector in a firearm receiver, the safety selector having a first supporting surface, wherein the first supporting surface is connected to the selector lever and wherein a detent of the firearm receiver is configured to only engage features of the first supporting surface when the safety selector is in a first position with respect to the firearm; extending a trigger camming surface from the first supporting surface; and extending a second supporting surface from the trigger camming surface, the second supporting surface being configured to movingly support the safety selector in the firearm receiver, the second supporting surface having features configured to only engage the detent when the safety selector is in a second position with respect to the firearm, the second position being inverted from the first position; and wherein the first features of the first supporting surface and the second supporting surface each define two index positions of the safety selector with respect to the receiver.

In still yet another embodiment, a method of providing a semi-automatic rifle with a reversible safety selector for ambidextrous use is provided. The method including the steps of: rotabably mounting a reversible safety selector in a bore of a receiver, the receiver having a first side and an opposite second side, the reversible safety selector having a selector member and a shaft extending therefrom, the shaft being rotationally received within the bore and the shaft further comprises a first position selection feature proximate to the selector member and a second position selection feature distal to the selector member, wherein a camming surface is located between the first position selection feature and the second position selection feature, and wherein the first position selection feature is configured to only engage a spring biased detent of the receiver when the reversible safety selector is rotated between a first position and a second position with respect to the receiver when the selector member is located on the first side of the receiver, and wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver regardless of which side of the receiver the selector is located on.

In still yet another embodiment, a method of changing the position of a safety selector switch of a semi-automatic rifle so that the safety selector switch can be operated by either a left or right handed user is provided. The method including the steps of: rotabably mounting a reversible safety selector in a bore of a receiver for right handed use, the receiver having a first side and an opposite second side, the reversible safety selector having a selector member and a shaft extending therefrom, wherein the selector moves adjacent to the first side when the reversible safety selector is rotatably mounted in the bore for right handed use and wherein the shaft further comprises a first position selection feature proximate to the selector member and a second position selection feature distal to the selector member and a camming surface located between the first position selection feature and the second position selection feature, wherein the first position selection feature engages a spring biased detent of the receiver when the reversible safety selector is rotated between a first position and a second position with respect to the receiver when the reversible safety selector is rotatably mounted in the bore for right handed use; removing the reversible safety selector from the bore; inserting the shaft of the reversible safety selector in the bore from the second side so that the shaft is rotatably mounted in the bore and the selector member moves adjacent to the second side of the receiver when the reversible safety selector is rotatably mounted in the bore for left handed use, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver regardless of which side of the receiver the selector is located on, wherein the first position selection feature is offset on the shaft by 180 degrees with respect to the second position selection feature located on the shaft.

In yet another embodiment, a firearm capable of semi-automatic fire is provided. The firearm having: a receiver having a moveable hammer located therein, the receiver having a bore therethrough; a selector rotatably mounted in the bore through the receiver, the selector having a selector member and a camming surface; and a trigger movably mounted in the receiver and having a sear thereon to engage the hammer, the camming surface of the selector being adapted to engage the trigger when rotated relative to the receiver; wherein, the selector has the following selectable positions: Safe, Semi and Auto for selection by rotation of the selector with respect to the receiver, and wherein, the selector is capable of being inserted into the bore from both a right side of the receiver and a left side of the receiver and wherein the selector is capable of selecting each one of the selectable positions from either side of the receiver regardless of which side of the receiver the selector is inserted from.

In still yet another embodiment, a combination of a rifle and a reversible selector capable of providing ambidextrous operation of the rifle is provided. The reversible selector being configured to be inserted into opposite sides of a receiver of the rifle to provide ambidextrous operation of the rifle wherein the reversible selector must be rotated 180 degrees after it is removed from one side of the receiver in order to be inserted into an opposite side of the receiver and wherein the rifle is capable of automatic and semi-automatic fire.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
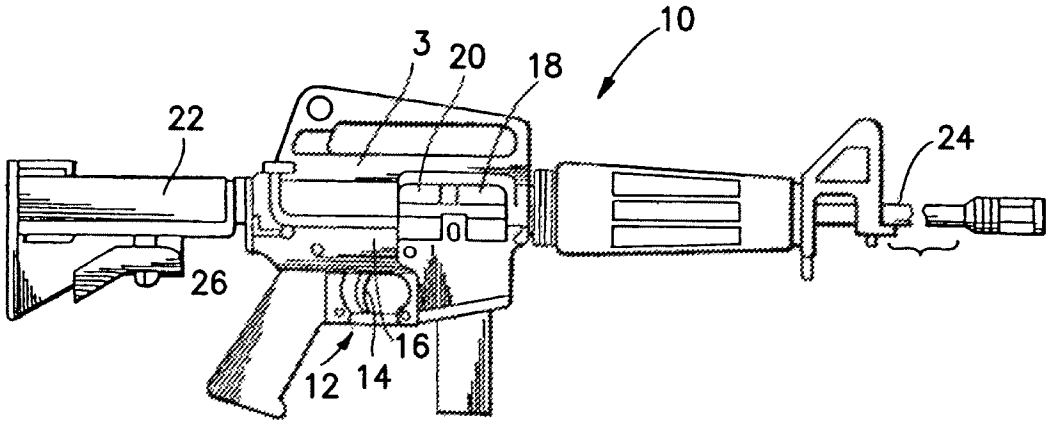
FIG. 1 is a side elevation view of a firearm incorporating features in accordance with an exemplary embodiment.

Referring to FIG. 1, there is shown, a side elevation view of a semi-automatic firearm 10 capable semi-automatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

In the exemplary embodiment shown in FIG. 1 firearm 10 is depicted as a black rifle type configuration. The black rifle type configuration being known as the family of rifles developed by Eugine Stoner, for example, such as an M-4™ (available from Colt Defense, LLC), M-16 or AR15 type firearms for example purposes. In alternate embodiments the firearm may be of any other suitable type. Firearm 10 incorporates a firing mechanism capable of operation at least in a semi-automatic mode. The firing mechanism may also be placed in a "SAFE" mode. The firearm 10 has a mode or fire control selector allowing a user to select the mode of operation of the firing mechanism, and hence the firearm selector is ambidextrous and reversible as will be described in greater detail below. The firearm 10 and its sections, described in greater detail below, is merely exemplary, and in alternate embodiments the firearm 10 may have other sections, portions or systems. For example, firearm 10 may comprise a firearm capable of semi-automatic and/or automatic fire, such as disclosed in co pending U.S. patent application Ser. No. 10/836,443 filed Nov. 3, 2005, which is hereby incorporated by reference in its entirety. The firearm generally has a receiver 12, that includes upper receiver section 3 and a lower receiver section 16. Firearm 10 also has a trigger 14, and a fire control selector or switch 26. The receiver 12 has a chamber 18 for receiving a bolt assembly 20. The rear portion of the chamber 18 may be defined by a receiver extension located in the stock 22 for receiving a buffer and operating spring. Connected to the forward portion of the chamber 18 is a barrel 24 having a cartridge chamber in which a cartridge may be positioned.

Figure 2:
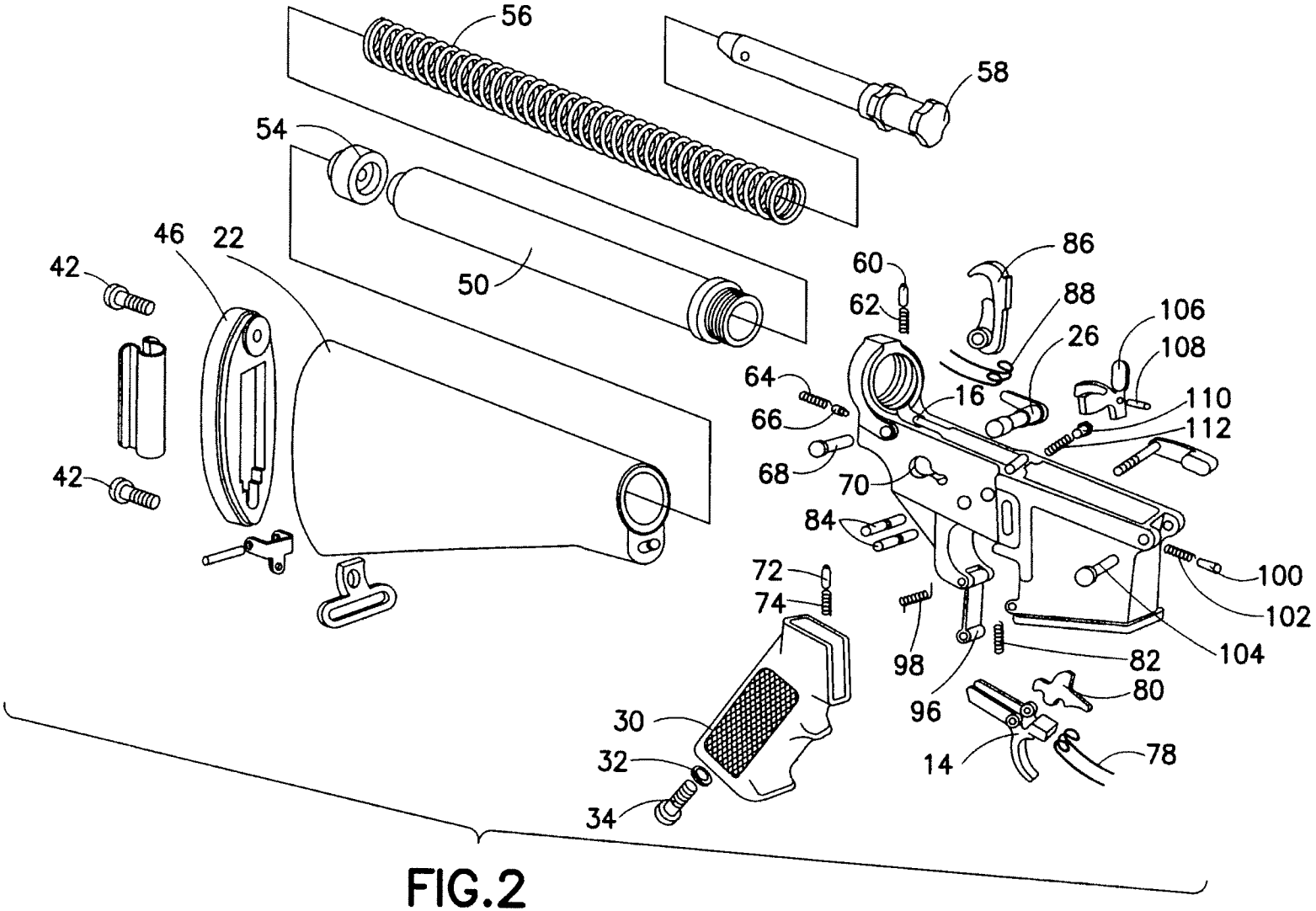
FIG. 2 is an exploded isometric view of the lower receiver and stock section of the firearm shown in FIG. 1.

Referring to FIG. 2, there is shown an exploded partial isometric view of the lower receiver and stock section of firearm 10 shown in FIG. 1. Pistol grip 30 is secured to lower receiver section 16 with fasteners (e.g. screw 34 and lock washer 32). The exemplary stock 22 has butt plate 46 and screws 42. In the exemplary embodiment, the receiver extension 50 is coupled to lower receiver 16 and has butt cap spacer 54. Action spring 56 and buffer assembly 58 are held within receiver extension 50 and captured by buffer retainer 60 and retainer spring 62. Takedown pin 68 is provided within lower receiver 16 with takedown pin detent 66 and spring 64. Safety selector lever 26 is provided in bore 70 of lower receiver 16 with detent 72 and detent spring 74. Trigger 14 is provided in lower receiver 16 with trigger spring 78, disconnector 80 and disconnector spring 82 on pin 84. Hammer 86 with hammer spring 88 are disposed in lower receiver 16 on pin 84. In the exemplary embodiment the receiver may have trigger guard 96 connected thereto by trigger guard roll pin 98. Spring pivot pin 104 is provided with pivot pin detent 100 and pivot pin spring 102. Bolt catch 106 is provided with bolt catch roll pin 108, bolt catch plunger 110, and bolt catch spring 112.

In the exemplary embodiment, the hammer 86 (see also FIGS. 9A-9B) is pivotally mounted with pin 84 to the receiver frame, the hammer is pivotally mounted to the receiver frame with another pin 84. In alternate embodiments the hammer and trigger may be movably mounted to the frame in any other desired manner. In the exemplary embodiment the trigger 14 has a sear 13 thereon for engaging the hammer. Fire control selector 26 is rotatably mounted in the receiver 12. The fire control selector 26 has a rotatable firing control cam 114 (see also FIG. 5). Cam 114 may be axially rotated (in directions 116 shown in FIG. 3A) for selecting among types of firing selections of the firearm. In the exemplary embodiment fire control selector 26 can be axially rotated from "SAFE" to "SEMI", and in reverse. In the "SAFE" position cam 114 engages the trigger 14 rotatably mounted in the receiver thereby fixing the sear 13 to engage the hammer 86. In alternate embodiments, the control cam 114 may have multiple sections for interacting with multiple components. For example, in alternate embodiments, control cam 114 may have a first section for interacting with an automatic sear, a second section for interacting with the rear end of the trigger, and a third section for interacting with the rear end of a semi-automatic disconnector. In alternate embodiments, the trigger, sear, hammer, disconnect or otherwise may have any other suitable configuration.

Figure 9A:
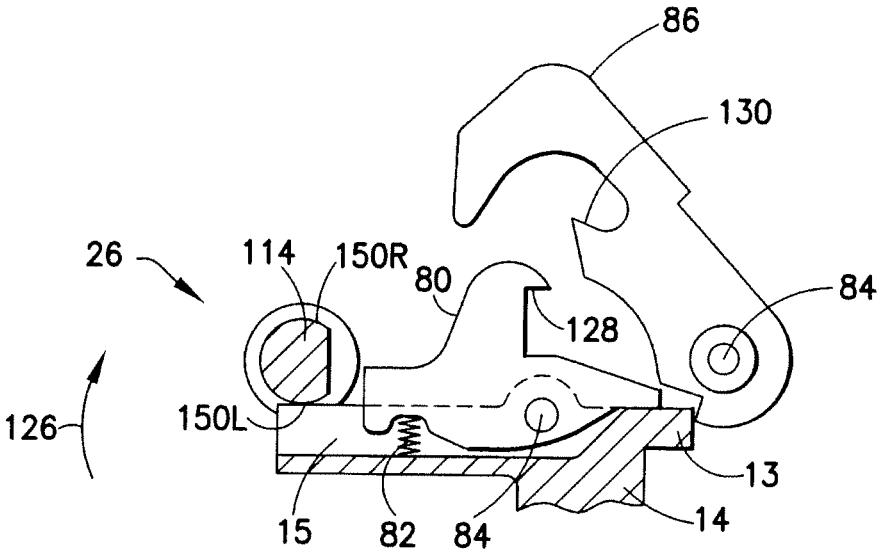
FIG. 9A is a partial side elevation view, partially in section of the firearm shown in FIG. 1 with the fire control selector in a "SAFE" position.
Figure 9B:
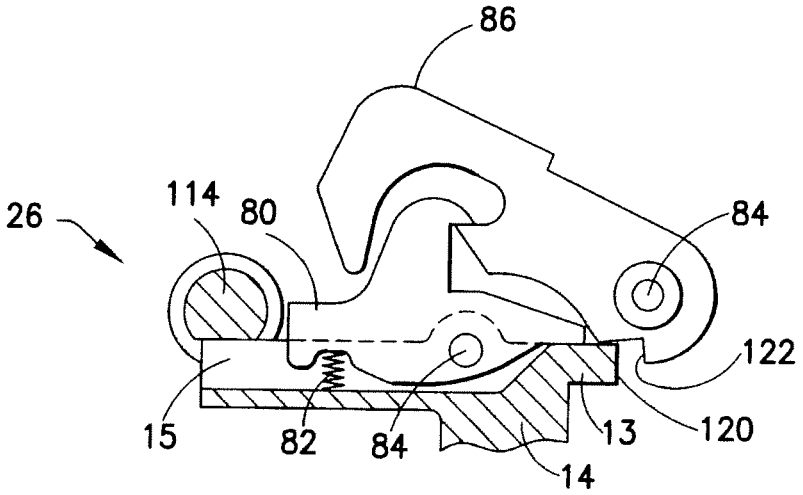
FIG. 9B is another partial side elevation view, partially in section of the firearm shown in FIG. 1 with the fire control selector in a semi-automatic position.

The trigger 14, as seen best in FIGS. 9A-9B, includes a rear portion 15. In alternate embodiments, the trigger may have any other desired shape. In the exemplary embodiment the front edge 120 of the trigger 14, defines main sear 13, and is adapted to catch the notch 122 of the hammer 86 when the hammer is in a locked position (see FIG. 9A) and, release the hammer 86 when the trigger 14 is pulled, thereby allowing the hammer to return from the cocked position to the battery position (not shown) under impetus of hammer spring 88 (see FIG. 2). Trigger spring 78 is provided on the trigger mounting pin 84 to bias the trigger to its battery position. The trigger 14 is shown in the battery position in FIG. 9A. The trigger is shown in its fully pulled position in FIG. 9B. As may be realized from FIGS. 9A-9B, a gap is formed between cam 114 and the rear portion 15 of trigger 14 when the trigger is at battery and the selector is in the "SEMI" position (shown in FIG. 9B). Conversely, when the selector is in the "SAFE" position (see FIG. 9A) the cam 114 engages rear portion 15 of trigger 14 to fix the trigger 14 in its battery position. Thus the control cam 114, (see FIG. 9A), limits axial rotation of the trigger 14 at the rear portion 15 on pin 84 in direction 126. In the exemplary embodiment, the semi-automatic disconnector 80 is pivotally mounted on a pin 84. The edge 128 of the semi-automatic disconnector 80 is adapted to catch the catch 130 of the hammer 86 (see FIG. 9B) after the trigger 14 is pulled and as the hammer is cocked by the cyclic action of the firearm. The disconnector 80 is moved, when the trigger 14 is released thereby releasing the hammer 86 (see FIG. 9A). A spring 82 is provided, such as between the trigger and disconnector for example, to bias the disconnector 80 towards the control hammer 86. Release of the hammer 86 by the disconnector allow the sear 13 to engage notch 122 of the hammer, holding the hammer in its cocked position.

Figure 3A:
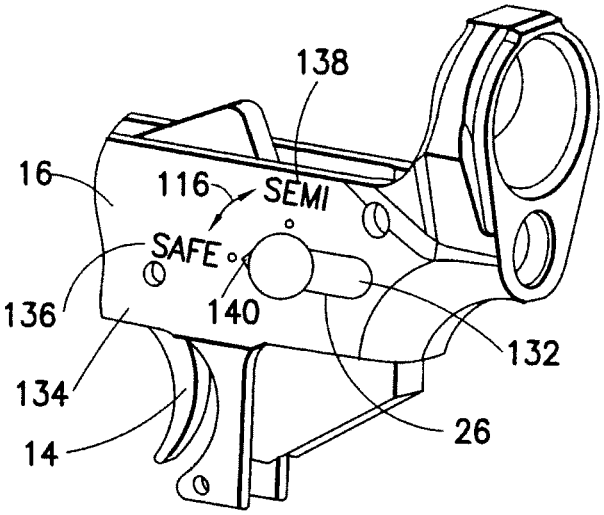
FIG. 3A is a partial isometric view of the left side of the lower receiver section of the firearm with fire control selector in a first position.
Figure 3B:
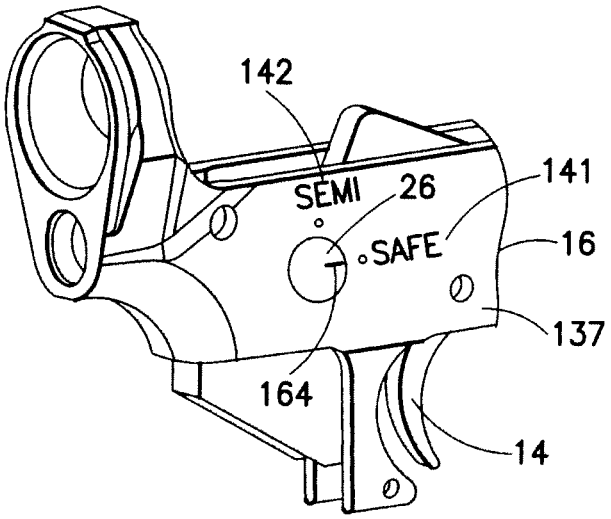
FIG. 3B is a partial isometric view of the right side of the lower receiver section of the firearm with the fire control selector in the first position.
Figure 4A:
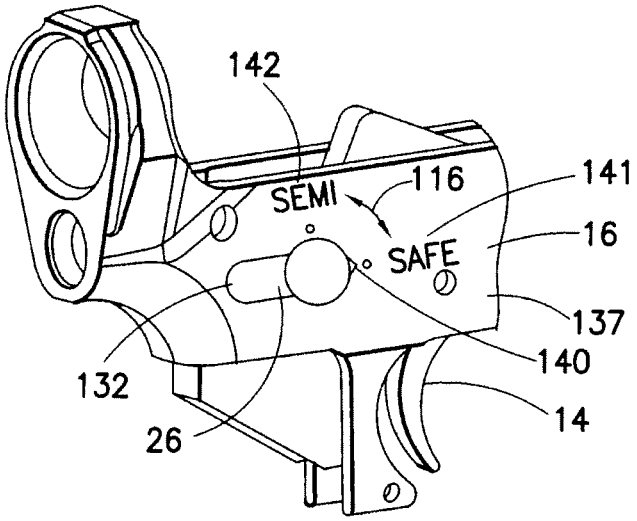
FIG. 4A is another partial isometric view of the right side of the lower receiver section of the firearm with the fire control selector in a second position.
Figure 4B:
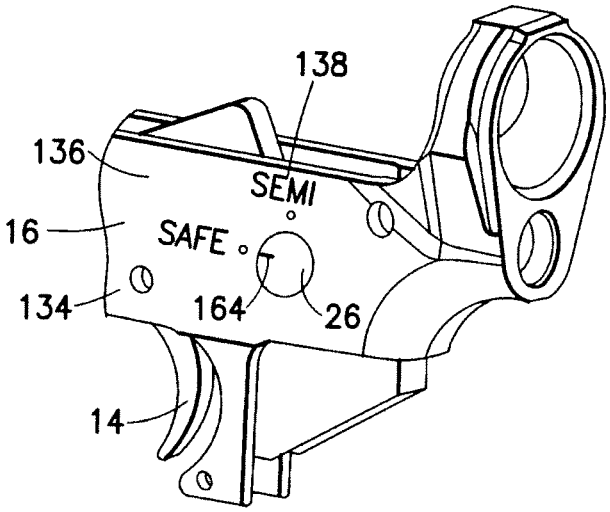
FIG. 4B is another partial isometric view of the left side of the lower receiver section of the firearm with the fire control selector in the second position.

Referring now to FIG. 3A, there is shown a partial isometric view of the left side of the lower receiver section of the firearm shown in FIG. 1. Referring also to FIG. 3B, there is shown a partial isometric view of the right side of the lower receiver section of the firearm shown in FIG. 1. FIGS. 3A-3B show the selector 26 mounted in the receiver in a first position (e.g. left side). Referring also to FIG. 4A, there is shown another partial isometric view of the right side of the lower receiver section of the firearm shown in FIG. 1. Referring also to FIG. 4B, there is shown another partial isometric view of the left side of the lower receiver section of the firearm shown in FIG. 1. FIGS. 4A-4B show the selector mounted in the receiver in a second position (e.g. right side). FIGS. 3A, 3B, 4A, 4B show the firearm 10 with the fire control selector 26 at the "SAFE" position. As noted before, the fire control selector 26 has a number of selectable fire control positions disposed. In this embodiment the fire control positions of fire control selector 26 include safe and fire positions. In alternate embodiments, other suitable positions may be provided, for example, semiautomatic and automatic positions. The rotation of the fire control selector 26 between the first and last selectable positions of the exemplary embodiment is about 90 degrees. In alternate embodiments, other positions or selector angles may be provided on different sides of receiver 16. In the exemplary embodiment, the fire control selector 26 has a switch handle 132 protruding from the side of the receiver 16.

Moreover, in the exemplary embodiment the switch of handle 132 of the selector is shaped and positioned on the side of the receiver to allow user operation (e.g. toggle) of the handle with fingers (e.g. the thumb) on the same hand as that with which the user is pulling the trigger 14 (i.e. the trigger hand). For example, the selector handle 132 has an elongated tab shape and extends rearwards from the selector pivot axis (see FIGS. 3A-4A) and is rotated through the rear lower quadrant to effect selection of the fire control positions of the selector). In this embodiment, the fire control selector 26 is capable of ambidextrous trigger hand operation, and may be removed from one side of receiver 16 as shown in FIG. 3A, inverted and replaced on the other side of receiver 16 as shown in FIG. 4A. As seen in FIG. 3A, in this embodiment the right side 134 of the receiver maybe indexed with position indicia, 136, 138 indicating the positions of the fire control selector 26. The handle 132 of the fire control selector may have for example a pointer 140 or other suitable indicator that points to or otherwise indicates a given indicated position 136, 138 that corresponds with the selected position of the selector 26. Additionally, selector 26 has indicator 164 that serves to indicate the selected position on the opposite side of receiver 16 as shown in FIGS. 3B and 4B. In the embodiment shown, a position indicia 136 corresponds selectable "SAFE" position of the selector that places the firearm in the "SAFE" operation mode (previously described), see also FIG. 9A. Position indicia 138 corresponds to the "SEMI" selector position the selection of which places the firearm in the semi-automatic operation mode (see also FIG. 9B). In alternate embodiments, other intermediate selectable position(s) or end position(s) may be provided. The total rotation of the fire control selector 26 between the "SAFE" position 136 and a "SEMI" position is about 90 degrees. Similar to the index indicia 136, 138 on side 134, the opposite side 137 of the firearm receiver may also have markings 141, 142 respectively indicating "SAFE" and "SEMI" selector positions. In the embodiment shown, the angular orientation of the "SAFE" indicia 136, 141 on the left and right sides of the receiver match relative to an axis of rotation of the selector. Additionally, the angular orientation of the "SEMI" position indicia 138, 142 on the left and right sides of the receiver also match relative to the axis of rotation of the selector. As seen in FIGS. 3A-3B, 4A-4B, the selector handle 132 has a generally similar orientation when the selector is mounted with the handle 132 on the left side 137 or the right side allowing the user for example to switch the selector with the trigger hand. For example, if the selector is mounted with handle 132 on the left side, the user using the right hand as the trigger hand, may switch the handle from "SAFE" to "SEMI" or vice versa with the trigger hand. Similarly, if the selector is mounted with the handle 132 on the right side, the user using the left hand as the trigger hand, may again switch the handle between "SAFE" and "SEMI" with the trigger hand. In alternate embodiments, the firearm operation mode associated with each of the selectable positions of the fire control selector may be established as desired. For example, an intermediate position may be the "SAFE" mode, and AUTO and "SEMI" modes may be at the fire control selectors end positions. In alternate embodiments, other suitable locations or differing angles may be provided.

Figure 5:
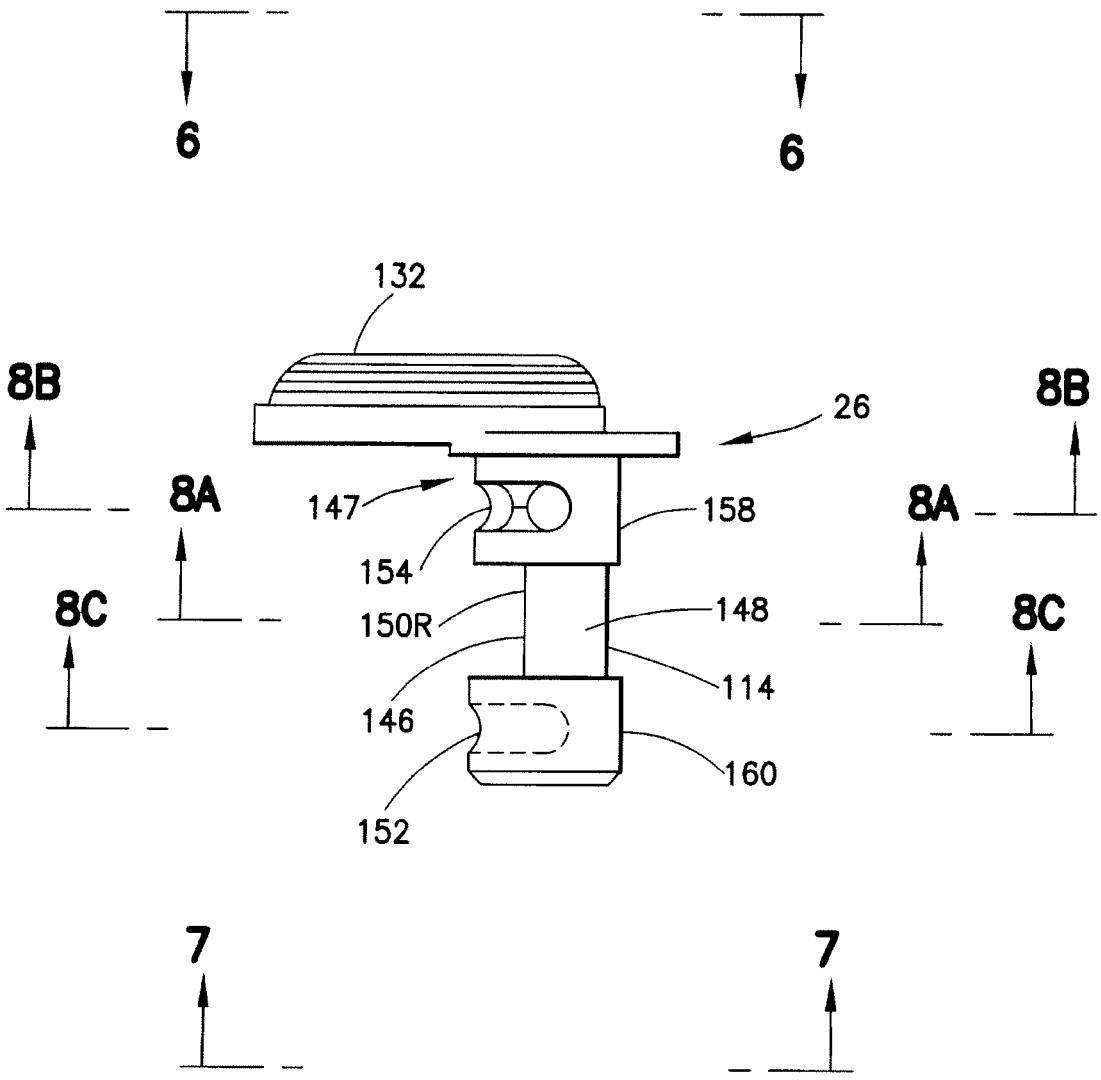
FIG. 5 is a top view of the fire control selector of the firearm in FIG. 1.
Figure 6:
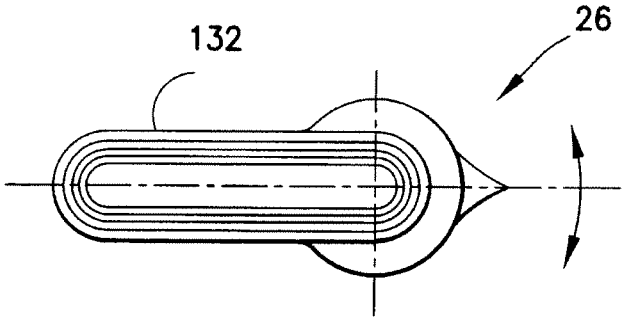
FIG. 6 is a side view of the fire control selector of the firearm in FIG. 1.
Figure 7:
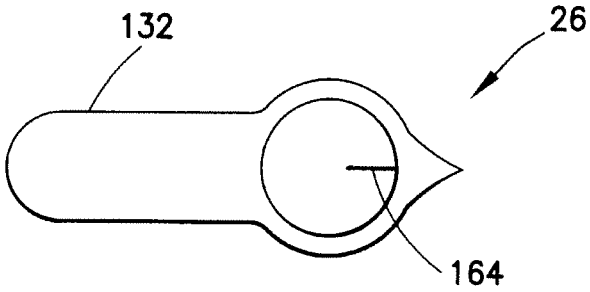
FIG. 7 is another side view of the fire control selector showing an opposite side from that shown in FIG. 6.
Figure 8A:
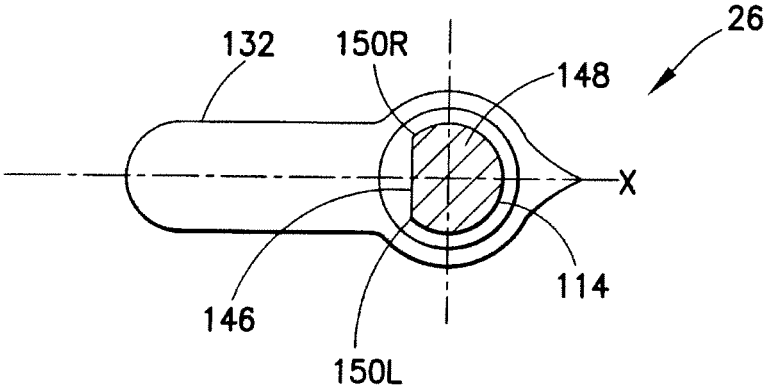
FIG. 8A is a section view of the fire control selector taken along lines 8A in FIG. 5.
Figure 8B:
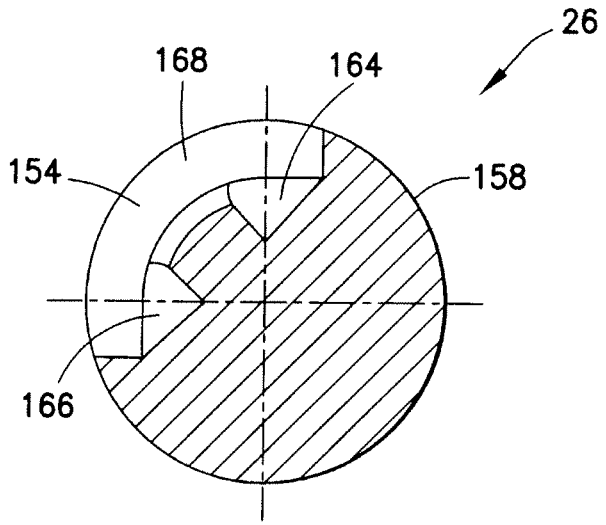
FIG. 8B is a partial section view of the fire control selector taken along lines 8B in FIG. 5.
Figure 8C:
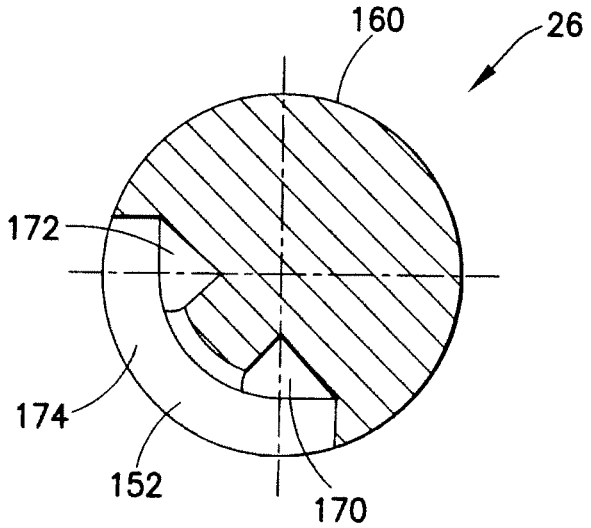
FIG. 8C is another partial section view of the fire control selector taken along lines 8C in FIG. 5.

Referring now to FIG. 5, there is shown a top view of a fire control selector 26 of the firearm in FIG. 1. Referring also to FIG. 6, there is shown a side view of the fire control selector of the firearm in FIG. 1. Referring also to FIG. 7, there is shown another side view of the fire control selector of the firearm in FIG. 1. Referring also to FIG. 8A, there is shown a section view of the fire control selector taken along line 8A in FIG. 5. Referring also to FIG. 8B, there is shown another partial section view of the fire control selector taken along line 8B in FIG. 5. Referring also to FIG. 8C, there is shown still another partial section view of the fire control selector taken along line 8C in FIG. 5. In the exemplary embodiment, the fire control selector 26 has an operator portion 147 and a selector handle 132. Selector 26 may be a one piece member of unitary construction. In alternate embodiments, the selector may be an assembly. In this embodiment, the operator portion 147 comprises a shaft with a camming portion or surface 114 and a support portion(s) 158, 160. Support portion(s) 158, 160 act as supporting surfaces and supports selector 26 in bore 70 (see also FIG. 2) of lower receiver 16. In the embodiment shown, shaft portions 158, 160 have a common diameter. In alternate embodiments, alternate diameters or surface(s) may be provided. In the embodiment shown, cam 114 of fire control selector 26 is a trigger camming surface 114. In alternate embodiments, other camming surfaces may be provided and may be disposed in any other desired positions. Operator portion 147 having cam 114 may be cast of metal with the sections cast therein, however in alternate embodiments such sections or the part itself could be cut or machined in one part out of a billet of material if desired. As noted before fire control selector 26 is reversible in that selector 26 may be mounted in bore 70 with the selector handle 132 on the right hand side of receiver 16, and removed from bore 70 of receiver 16, rotated 180 degrees and mounted in bore 70 with the selector handle 132 on the left hand side of receiver 16. As seen in FIG. 5, in the exemplary embodiment, shaft portions 158, 160 have selector positioning or indexing features. Distal selector position feature 152 is provided on shaft portion 160 at an opposite end of the shaft from handle 132. Proximal selector position feature 154 is provided on shaft portion 158 proximate the handle 132. Distal selector position feature 152 engages spring loaded detent 72 (see FIG. 2) when selector tab 132 is on the left side of the receiver. Proximal selector position feature 154 engages detent 72 when selector tab 132 is on the right side of the receiver. In alternate embodiments, other suitable combinations of detent(s) and detent location(s) and selector features may be provided. As seen in FIGS. 5 and 8B-8C the distal 152 and proximal 154 selector position features each in the exemplary embodiment have two indexing or detent engagement locations. The proximal features 154 and distal features 152 are substantially symmetrical about a surface in common with the horizontal axis of FIG. 8A of the selector and offset one from the other along the rotation axis of the selector as seen in FIGS. 5 and 8B, 8C. Distal selector position feature 152 has recesses 170, 172 and guide section 174 providing the fire control selector 26 with an indexer for holding the fire control selector in each selector position (e.g. "SAFE", "SEMI"). The recesses 170, 172 are adapted to be engaged by the detent or moveable plunger 72 (see FIG. 2) of the firearm 10 for holding the fire control selector 26 in each selectable position when tab 132 is on the left hand side of receiver 16 e.g. (recess 170 for "SAFE" and recess 172 for "SEMI"). Proximal selector position feature 154 has recesses 164, 166 and guide section 168 providing the fire control selector 26 with an indexer for holding the fire control selector in each selector position (e.g. "SAFE", "SEMI"). The recesses 166, 164 are adapted to be engaged by a detent moveable plunger 72 (see FIG. 2) of the firearm 10 for holding the fire control selector 26 in each selectable position when tab 132 is on the right side of receiver 16 (e.g. recess 164 for "SAFE" and recess 166 for "SEMI"). In this embodiment, the index recesses are shown as being generally rounded/conical to complement a rounded/conical plunger. In alternate embodiments, the selector indexer may have any other desired shape. The recesses 154, 152 are located around circumferences 158, 160 to coincide with the selector position when in "SAFE" and "SEMI" modes. Hence, the circumferential pitch between adjacent recesses is the same as the rotational separation between selector positions.

The trigger camming surface 114 is arranged so that, as described before when the selector is installed in a firearm receiver 12, the trigger camming surface 114, upon selection of a desired mode of operation with the selector handle, is positioned relative to trigger 14, of the firearm 10, to place the firearm in an operation mode corresponding to the selection. In this embodiment the camming surface is formed to be positioned for engagement and disengagement of the trigger, thereby giving effect to the selector positions that are about 90° apart. In alternate embodiments, other selector position angles may be provided. In this embodiment camming surface 114 has a land 146 and diameter 148 for contacting the trailing leg (see also FIGS. 9A, 9B) of trigger 14 when the fire control selector is in a semi-automatic position (FIG. 9B) and "SAFE" position (FIG. 9A) respectively. Diameter 148 defines opposing stops 150L, 150R projecting from the land 146 where the stop contacts the trailing leg 15 of trigger 14 when the fire control selector 26 is in a "SAFE" position as will be described in greater detail below. Camming surface 114 has a first engagement portion comprising the half of camming surface above the horizontal axis X of FIG. 8A and terminating in stop 150R. Camming surface 114 has a second engagement portion comprising the half of camming surface below the horizontal axis of FIG. 8A and terminating in stop 150L. Here, the first portion 150R engages the trigger 14 when handle 132 is on the right side of the receiver and the second portion 150L (see FIG. 9A) engages the trigger 14 when handle 132 is on the left side of the receiver. The first and second engagement portions may be generally symmetrical and mirrored about a plane or surface in common with the horizontal axis and the axis X of rotation of the selector. As noted before selector handle or lever 132 may be used to position the camming surface 114 by indexing the selector to the desired position. In this exemplary embodiment, the fire control selector 26 is ambidextrous and is hence provided where the selector may be removed, inverted and replaced.

Referring again to FIG. 9A, there is shown a partial side elevation view, partially in section of the firearm shown in FIG. 1 with the fire control selector 26 in the "SAFE" position. Referring also to FIG. 9B, there is shown a partial side elevation view, partially in section of the firearm shown in FIG. 1 with the fire control selector 26 in the "SEMI" or semi-automatic position. With the fire control selector in the "SAFE" position shown in FIG. 9A, the end portion 15 of trigger 14 contacts the surface 148 of fire control selector 26. This limits the rotation of the trigger, which locks the main sear 13 on the trigger in position engaging catch 122 of the hammer 86. In this position, the trigger can not be pulled sufficiently to release hammer 86. When the fire control selector 26 is rotated to the "SEMI" setting, the control cam 114 is rotated to the position shown in FIG. 9B. In this position, the end of trigger 14 contacts the surface 146 of fire control selector 26. Thus, control cam 114 allows the trigger to be pulled to release hammer 86 and leaves disconnect 80 free to engage hammer 86 after the trigger has been pulled as shown such that the disconnect 80 is operable. The control cam 114 can be rotated clockwise and counterclockwise to move from firing selections including "SAFE" and semi-automatic and back to "SAFE".

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of providing a semi-automatic rifle with a reversible safety selector, comprising:

removably and rotatably locating a reversible safety selector in a receiver having a first side and an opposite second side, the reversible safety selector having a selector member and a shaft extending therefrom, the shaft being rotationally received within the receiver and the shaft further comprising a first position selection feature proximate to the selector member and a second position selection feature distal to the selector member, wherein a camming surface is located between the first position selection feature and the second position selection feature, wherein the first position selection feature is configured to only engage a spring biased detent of the receiver when the reversible safety selector is rotated between a first position and a second position with respect to the receiver when the selector member is located on the first side of the receiver, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver.

2. The method of claim 1, wherein a distal end of the shaft is visible on either the first side or the second side of the of the receiver opposite the selector member and wherein the distal end of the shaft has an indicator located thereon, wherein the indicator is aligned with indicia disposed on the receiver as the reversible safety selector is rotated between the first position and the second position with respect to the receiver.

3. The method of claim 1, wherein a distal end of the shaft is visible on either the first side or the second side of the receiver opposite the selector member and wherein the distal end of the shaft has an indicator located thereon, wherein the indicator is aligned with indicia disposed on the receiver as the reversible safety selector is rotated between the first position and the second position with respect to the receiver and wherein the selector member has a selector position indicator and wherein, the selector position indicator and the indicator each have the same angular orientation relative to an axis of rotation of the reversible safety selector.

4. A method of providing a firearm capable of semi-automatic fire, the method comprising:

removably and rotatably locating a selector in a bore extending through a receiver having a moveable hammer, the selector having a selector member, a pair of first detent engagement features, a pair of second detent engagement features and a camming surface positioned between the pair of first detent engagement features and the pair of second detent engagement features; and a trigger movably mounted to the receiver and having an integral sear configured to engage the hammer, wherein the camming surface of the selector is configured to engage the trigger when the selector is rotated relative to the receiver; and wherein the selector is capable of being removably inserted into the bore from both a right side of the receiver and a left side of the receiver and wherein, the receiver further comprises a spring biased detent, and wherein, the pair of first detent engagement features only engage the detent when the selector member is located on the right side of the receiver and the pair of second detent engagement features only engage the detent when the selector member is located on the left side of the receiver.

5. The method of claim 4, wherein the pair of first detent engagement features, the pair of second detent engagement features and the camming surface are formed on a shaft of the selector extending from the selector member.

6. The method of claim 4, wherein the receiver has "SAFE" and firing position indicia on both the left and right sides, and wherein the angular orientation of the "SAFE" and firing indicia position on the left and right hand sides of the receiver is substantially the same relative to an axis of rotation of the selector.

7. The method of claim 4, wherein the pair of first detent engagement features are located on an opposite side of the shaft with respect to the pair of second detent engagement features such that the selector must be inverted when removed from the first side of the receiver in order to allow for the pair of second detent engagement features to engage the detent when the selector is inserted into the left side of the receiver.

8. The method of claim 4, wherein the selector member is a tab extending away from a shaft of the selector and a first selector position indicator extends from the tab, and wherein a second selector position indicator is located on an opposite end of the shaft with respect to the tab, and the first selector position indicator and the second selector position indicator each have the same angular orientation relative to an axis of rotation of the shaft.

9. The method of claim 4, wherein the pair of first detent engagement features and the pair of second detent engagement features each define two selectable positions of the selector.

10. The method of claim 4, wherein the camming surface has first and second engagement portions mirrored about a common axis of the selector, wherein the first engagement portion engages the trigger when the selector lever is on the right side of the receiver and the second engagement portion engages the trigger when the selector lever is on the left side of the receiver.

11. The method of claim 4, wherein the pair of first detent features and the pair of second detent features each define two selectable positions of the selector, wherein the two selectable positions of the selector define two different operational modes of the firearm, wherein the two different operational modes comprises a "SAFE" mode and a semi-automatic mode.

12. The method of claim 4, wherein the selector member is a tab extending away from a shaft of the selector, wherein the tab extends from the shaft towards a rear of the firearm when the tab is on either the left side or the right side of the receiver.

13. A method of providing a safety selector in a semi-automatic firearm, the method comprising:

movingly supporting a safety selector in a firearm receiver, the safety selector having a first supporting surface, wherein the first supporting surface is connected to the selector lever and wherein a detent of the firearm receiver is configured to only engage features of the first supporting surface when the safety selector is in a first position with respect to the firearm;

extending a trigger camming surface from the first supporting surface; and extending a second supporting surface from the trigger camming surface, the second supporting surface being configured to movingly support the safety selector in the firearm receiver, the second supporting surface having features configured to only engage the detent when the safety selector is in a second position with respect to the firearm, the second position being inverted from the first position; and wherein the first features of the first supporting surface and the second supporting surface each define two index positions of the safety selector with respect to the receiver.

14. The method of claim 13, wherein the first supporting surface, the camming surface and the second supporting surface are integrally formed on a shaft of the safety selector.

15. The method of claim 14, wherein one end of the shaft is configured to be inserted through a bore of the firearm receiver and another end of the shaft has a selector lever secured thereto.

16. The method of claim 13, wherein the first supporting surface and second supporting surface define an axis of rotation of the safety selector when mounted in the firearm receiver and wherein the trigger camming surface has first and second trigger engagement portions symmetrical about the axis of rotation.

17. The method of claim 1, wherein the first position selection feature comprises a pair of recesses separated by a guiding feature, each of the pair of recesses being configured to receive a portion of the spring biased detent therein.

18. The method of claim 17, wherein the second position selection feature comprises a pair of recesses separated by a guiding feature, each of the pair of recesses being configured to receive a portion of the spring biased detent therein.

19. The method of claim 4, wherein the first pair of detent engagement features are separated by a guiding feature and the second pair of detent engagement features are separated by another guiding feature.

20. The method of claim 13, wherein the features of the first supporting surface and the second supporting surface are separated by a guiding feature and wherein the features of the supporting surface and the second supporting surface are off set from each other by 90 degrees.

21. A method of providing a semi-automatic rifle with a reversible safety selector for ambidextrous use, comprising:

rotabably mounting a reversible safety selector in a bore of a receiver, the receiver having a first side and an opposite second side, the reversible safety selector having a selector member and a shaft extending therefrom, the shaft being rotationally received within the bore and the shaft further comprises a first position selection feature proximate to the selector member and a second position selection feature distal to the selector member, wherein a camming surface is located between the first position selection feature and the second position selection feature, and wherein the first position selection feature is configured to only engage a spring biased detent of the receiver when the reversible safety selector is rotated between a first position and a second position with respect to the receiver when the selector member is located on the first side of the receiver, and wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver regardless of which side of the receiver the selector is located on.

22. A method of changing the position of a safety selector switch of a semi-automatic rifle so that the safety selector switch can be operated by either a left handed user or right handed user, comprising:

rotabably mounting a reversible safety selector in a bore of a receiver for right handed use, the receiver having a first side and an opposite second side, the reversible safety selector having a selector member and a shaft extending therefrom, wherein the selector moves adjacent to the first side when the reversible safety selector is rotatably mounted in the bore for right handed use and wherein the shaft further comprises a first position selection feature proximate to the selector member and a second position selection feature distal to the selector member and a camming surface located between the first position selection feature and the second position selection feature, wherein the first position selection feature engages a spring biased detent of the receiver when the reversible safety selector is rotated between a first position and a second position with respect to the receiver when the reversible safety selector is rotatably mounted in the bore for right handed use;

removing the reversible safety selector from the bore;

inserting the shaft of the reversible safety selector in the bore from the second side so that the shaft is rotatably mounted in the bore and the selector member moves adjacent to the second side of the receiver when the reversible safety selector is rotatably mounted in the bore for left handed use, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver regardless of which side of the receiver the selector is located on, wherein the first position selection feature is offset on the shaft by 180 degrees with respect to the second position selection feature located on the shaft.

23. A method of providing a semi-automatic rifle with a reversible safety selector, comprising:

removably and rotatably locating a reversible safety selector in a receiver having a first side and an opposite second side, the reversible safety selector having a selector member, a first position selection feature proximate to the selector member and a second position selection feature distal to the selector member, wherein a camming surface is located between the first position selection feature and the second position selection feature, wherein the first position selection feature is configured to only engage a spring biased detent of the receiver when the reversible safety selector is rotated between a first position and a second position with respect to the receiver when the selector member is located on the first side of the receiver, wherein the second position selection feature is configured to only engage the spring biased detent of the receiver when the reversible safety selector is rotated between the first position and the second position with respect to the receiver when the selector member is located on the second side of the receiver, and wherein the camming surface contacts a portion of a trigger of the firearm as the reversible safety selector is rotated between the first position and the second position with respect to the receiver.

24. A method of providing a reversible selector of a rifle, comprising:

inserting the reversible selector into a first side of a receiver of the rifle wherein a first detent feature proximate to a selector member of the reversible selector engages a spring biased detent of the rifle and a camming surface of the reversible selector engages a portion of a trigger of the rifle;

removing the reversible selector from the first side of the receiver;

inserting the reversible selector into a second side of the receiver, the second side being opposite the first side of the receiver wherein a second detent feature distal to the selector member engages the spring biased detent of the rifle and the camming surface of the reversible selector engages the portion of the trigger of the rifle; and wherein the first detent feature only engages the spring biased detent when the reversible selector is inserted into the first side of the receiver and wherein the second detent feature only engages the spring biased detent when the reversible selector is inserted into the second side of the receiver, and wherein the rifle is capable of automatic and semi-automatic fire and wherein the reversible selector is rotatable between at least the following selectable positions: Safe, Semi and Auto via rotation of the reversible selector with respect to the receiver and wherein the reversible selector is capable of selecting each one of the selectable positions from either the first side or the second side of the receiver regardless of which side of the receiver the selector is inserted from.

* * * * *